US010933951B2

(12) United States Patent
Oakes

(10) Patent No.: US 10,933,951 B2
(45) Date of Patent: Mar. 2, 2021

(54) MARINE WINDSHIELD WITH FORWARD ACCENT

(71) Applicant: Taylor Made Group, LLC, Gloversville, NY (US)

(72) Inventor: Philip A. Oakes, Middle Grove, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 73 days.

(21) Appl. No.: 16/383,961

(22) Filed: Apr. 15, 2019

(65) Prior Publication Data

US 2019/0315437 A1 Oct. 17, 2019

Related U.S. Application Data

(60) Provisional application No. 62/658,673, filed on Apr. 17, 2018.

(51) Int. Cl.
*B63B 19/02* (2006.01)
*B63B 45/04* (2006.01)

(52) U.S. Cl.
CPC ..... *B63B 19/02* (2013.01); *B63B 45/04* (2013.01)

(58) Field of Classification Search
CPC ..... B63B 19/02; B63B 45/04; B63B 19/04; B63B 45/08; B63J 2/04
USPC ..... 381/389; 428/38; 296/200, 201, 96.21, 296/84.1, 77.1; 114/361
See application file for complete search history.

(56) References Cited

U.S. PATENT DOCUMENTS 3,016,548 A * 1/1962 Taylor ..... B63B 19/02 114/361
3,123,839 A * 3/1964 Reid ..... B60J 1/04 114/361
3,810,267 A 5/1974 Fussell, Jr.
4,815,410 A * 3/1989 Muhlberger ..... B63B 19/02 114/361
D328,240 S 7/1992 Polski
D331,560 S 12/1992 Ivey
5,203,277 A 4/1993 Norman
5,269,250 A * 12/1993 Daniels ..... B63B 19/02 114/343
5,309,860 A 5/1994 Shearer
D348,040 S 6/1994 Shearer et al.
D363,264 S 10/1995 Mullin
5,601,050 A 2/1997 Erskine
5,784,982 A 7/1998 Erskine
D410,890 S 6/1999 Consaul
(Continued)

*Primary Examiner* — Anthony D Wiest
(74) *Attorney, Agent, or Firm* — Nixon & Vanderhye P.C.

(57) ABSTRACT

A windshield assembly includes a windshield with a starboard side section, a port side section, and a center section between the starboard side section and the port side section. Transition areas of the windshield between the starboard side section and the center section and between the port side section and the center section, respectively, each include a transition radius. A bottom trim member is securable to a deck or frame with a profile including a starboard corner radius and a port corner radius. The bottom trim member supports the windshield and includes a pair of transition members disposed at the transition areas of the windshield. The transition members are configured to adapt the transition areas of the windshield to the deck profile.

17 Claims, 3 Drawing Sheets

(56) References Cited

U.S. PATENT DOCUMENTS

| | | | |
|---|---|---|---|
| D467,860 | S | 12/2002 | Aube et al. |
| 6,558,029 | B2 | 5/2003 | Spring, Jr. |
| 6,647,914 | B1 | 11/2003 | Gerhardinger |
| D510,902 | S | 10/2005 | Erskine |
| 7,111,355 | B1 | 9/2006 | Sorensen |
| 7,248,010 | B2 | 7/2007 | Michiyama |
| D555,070 | S | 11/2007 | Bach |
| D558,660 | S | 1/2008 | Malcore et al. |
| D569,782 | S | 5/2008 | Bach |
| D571,277 | S | 6/2008 | Bach |
| D571,706 | S | 6/2008 | Bach |
| 7,424,765 | B1 | 9/2008 | Stevens |
| D583,285 | S | 12/2008 | Lapointe et al. |
| D593,024 | S | 5/2009 | Bach |
| D598,837 | S | 8/2009 | Wanglund |
| D701,820 | S | 4/2014 | Pierce et al. |
| D723,438 | S | 3/2015 | Ross et al. |
| D775,028 | S | 12/2016 | Bach |
| 9,534,764 | B2 | 1/2017 | Trajlinek et al. |
| D785,504 | S | 5/2017 | Higgs |
| 9,688,363 | B1 | 6/2017 | Marshall |
| 10,124,861 | B2 | 11/2018 | Dube |
| D838,654 | S | 1/2019 | Daniels |
| D851,016 | S | 6/2019 | Oakes |
| D851,573 | S | 6/2019 | Oakes |
| 2002/0184842 | A1 | 12/2002 | Norman |
| 2018/0072386 | A1 | 3/2018 | Dube |

* cited by examiner

MARINE WINDSHIELD WITH FORWARD ACCENT

CROSS-REFERENCES TO RELATED APPLICATIONS

This application claims the benefit of U.S. Provisional Patent Application No. 62/658,673, filed Apr. 17, 2018, the entire content of which is herein incorporated by reference.

STATEMENT REGARDING FEDERALLY SPONSORED RESEARCH OR DEVELOPMENT (NOT APPLICABLE)

BACKGROUND

The invention relates to a windshield assembly including a forward accent and, more particularly, to a windshield assembly with a forward accent that serves to facilitate a transition from a deck or frame to the windshield glass.

Marine windshields are sometimes assembled in sections including side sections separated by a pillar or the like from a center section. It is not uncommon for the center section to include a door or window that enables occupants to pass through.

To accommodate the sharp angles between the side sections and the front section, in some constructions, the side sections are manufactured and installed separately from the front sections. In this manner, a turn angle between the side sections and the front sections can be accommodated without requiring bending of the glass.

Marine windshields using bent glass between side sections and front sections can eliminate pillars, resulting in a cleaner, more modern appearance. It is difficult, however, to bend the glass at sharper angles. Additionally, when glass is bent beyond a certain point, a view through the glass can become distorted, which is undesirable for a marine windshield.

BRIEF SUMMARY

It would be desirable to provide a transition section/member in the form of a forward accent to reduce the curve amount/radius for bent glass between side sections and a front section while accommodating a deck shape that requires a sharper bend in the glass. The transition accommodates the sharper turn by enabling the bends in the glass to cut across the corners defined by a shape of the deck. The transition member may also accommodate an opposite construction where a turn from windshield sides to center is sharper than the deck profile. The transition pieces advantageously provide opportunities for various forward accents and components that further enhance the appearance and/or functionality of the windshield assembly.

In an exemplary embodiment, a windshield assembly includes a windshield with a starboard side section, a port side section, and a center section between the starboard side section and the port side section. Transition areas of the windshield between the starboard side section and the center section and between the port side section and the center section, respectively, each include a transition radius. A bottom trim member is securable to a deck or frame with a profile including a starboard corner radius and a port corner radius. The bottom trim member supports the windshield and includes a pair of transition members disposed at the transition areas of the windshield. The transition members are configured to adapt the transition areas of the windshield to the starboard and port corner radii of the profile.

The starboard corner radius and the port corner radius may be different from the transition radii.

In some embodiments, the profile includes starboard and port outermost corners, and the transition members may be configured to occupy the starboard and port outermost corners of the profile. The transition members may include an outermost bend point that matches the outermost corners of the profile, where the transition members extend aft and inward from the outermost bend point to an inside point. The transition areas of the windshield may extend adjacent the inside point of the transition members. The transition areas of the windshield may be configured to cut across the outermost corners of the profile.

The transition members may extend through the windshield. The transition members may include a functional component, such as a light source.

In some embodiments, the windshield may include a first pillar between the starboard side section and the center section and a second pillar between the port side section and the center section. In this context, the first and second pillars may engage an inside portion of the transition members.

In another exemplary embodiment, a windshield assembly includes a windshield with a starboard side section, a port side section, and a center section between the starboard side section and the port side section. A bottom trim member that supports the windshield is securable to a deck or frame with a profile including starboard and port outermost corners. The bottom trim member includes a pair of transition members disposed at respective transition areas between the starboard side section and the center section and between the port side section and the center section. The windshield is configured to cut across the transition members.

A trim radius of the transition members at junctions between the starboard side section and the center section and between the port side section and the center section may be smaller than a radius of the windshield at the transition areas.

BRIEF DESCRIPTION OF THE DRAWINGS

These and other aspects and advantages will be described in detail with reference to the accompanying drawings, in which.

DETAILED DESCRIPTION

Figure 1:
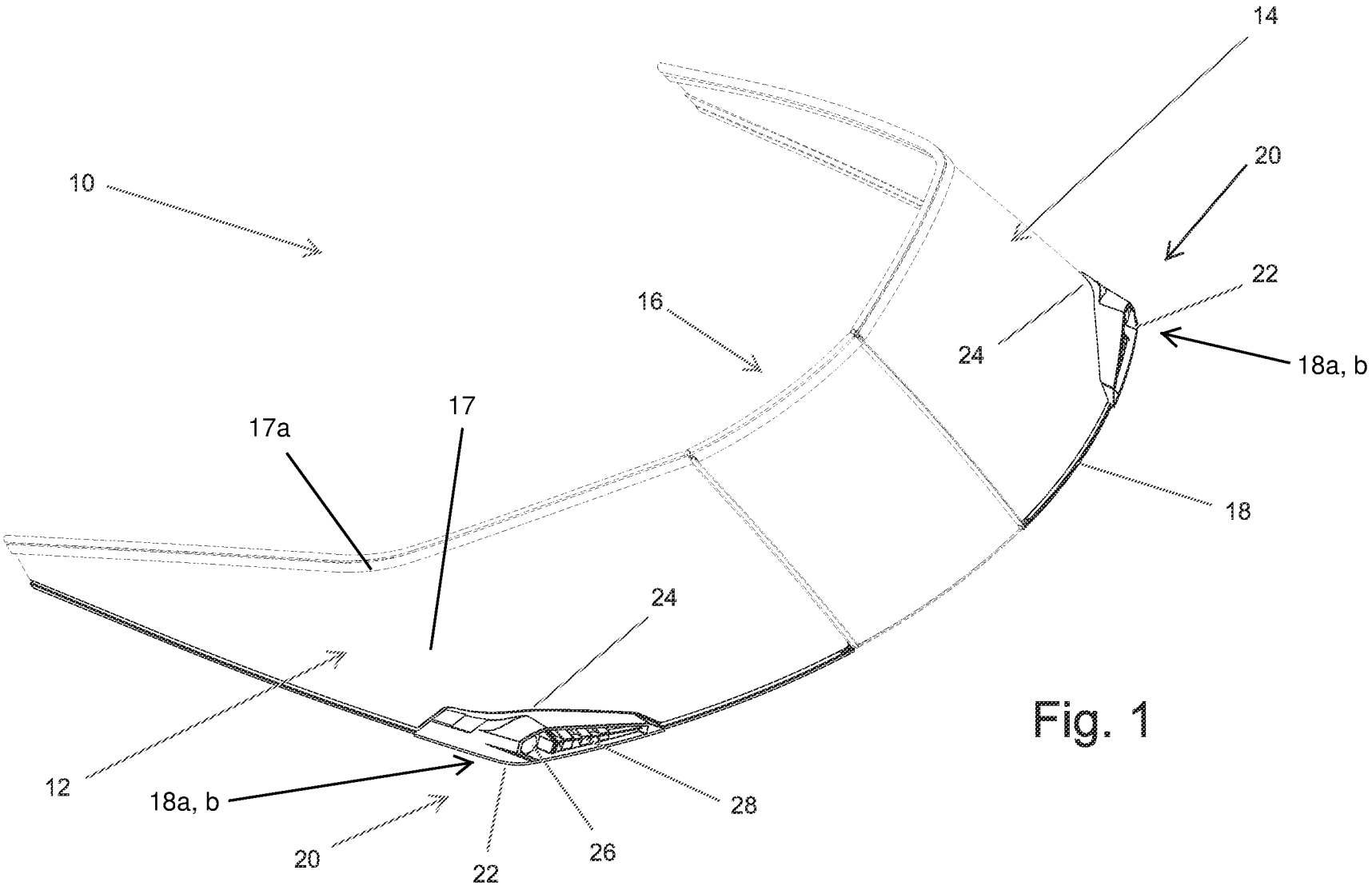
FIG. 1 is a perspective view of a windshield assembly including a forward accent in the form of transition members.

With reference to the drawings, the windshield assembly 10 according to preferred embodiments is constructed in three sections including a starboard side section 12, a port side section 14, and a center section 16. Transition areas 17 are defined between the starboard side section 12 and the center section 16 and between the port side section 14 and the center section 16. Each of the transition areas includes a transition radius 17*a*. The center section 16 may include a section connected via a hinge or the like to serve as a door or pass-through. In an alternative construction, the windshield sections 12, 14, 16 may be formed by a single piece of glass.

A bottom trim member 18 is secured to a deck or frame having a profile including starboard and port outermost corners 18*a* with respective starboard and port corner radii 18*b*. The bottom trim member 18 supports the glass on the deck or frame. Any suitable bottom trim configuration may be used. Conventional constructions enable the trim 18 to accommodate both the generally upright glass portions on the sides of the windshield as well as the angled front section(s) of the windshield.

At the corners (i.e., transition areas) where the windshield bends from the side sections to the center section, the bottom trim 18 includes a pair of transition members 20. The transition members 20 serve as adapters between the deck profile and the curvature of the windshield. That is, in some configurations, the starboard and port corner radii are different from the transition radii, and the transition members 20 provide for a clean transition. In some embodiments, for example, the transition members 20 are configured to occupy the starboard and port outermost corners of the profile.

As shown, the transition members 20 are generally defined by corner pieces that include an outermost bend point 22. The transition members 20 incorporate a bend/radius that matches the deck profile and accommodates a larger radius from the windshield sides to the windshield front. In the embodiment shown in FIG. 1, the transition members 20 extend aft and inward from the bend point 22 to an inside point 24. The glass is supported by suitable structure adjacent the inside point 24. The bends/radii of the windshield between the starboard side section 12 and the center section 16 and between the port side section 14 and the center section 16 are configured to cut across the transition members 20 and across the outermost corners of the profile. That is, a trim radius of the transition members 20 at junctions between the starboard side section 12 and the center section 16 and between the port side section 14 and the center section 16 is smaller than the radii of the windshield at the transition areas. Because the inside point 24 is aft and inward relative to the bend point 22, the bend in the glass can be made much more gradual therefore not affecting the view through the glass. Additionally, the less substantial bend is easier to manufacture.

The transition member 20 is three-dimensional and may extend from a position in front of the windshield through to the other side of the windshield. That is, the transition members 20 are positioned underneath the windshield. The transition members 20 thus present opportunities for additional functionality to be incorporated into the windshield assembly 10. For example, FIG. 1 shows the transition members 20 incorporating a light source 26 as well as accent lighting 28. Other exemplary applications may include, without limitation, a storage area (closed or open, toward outside or inside the windshield or both), a pass-through for handing objects etc. through the windshield between occupants, an integrated ventilation system, docking lights, directional spotlighting, accent lighting, navigation lights, speakers and/or other audio equipment (facing inward and/or outward), electrical outlets and port access, etc. Still further, the transition piece 20 can alternatively be a solid block including only decorative features.

Figure 2:
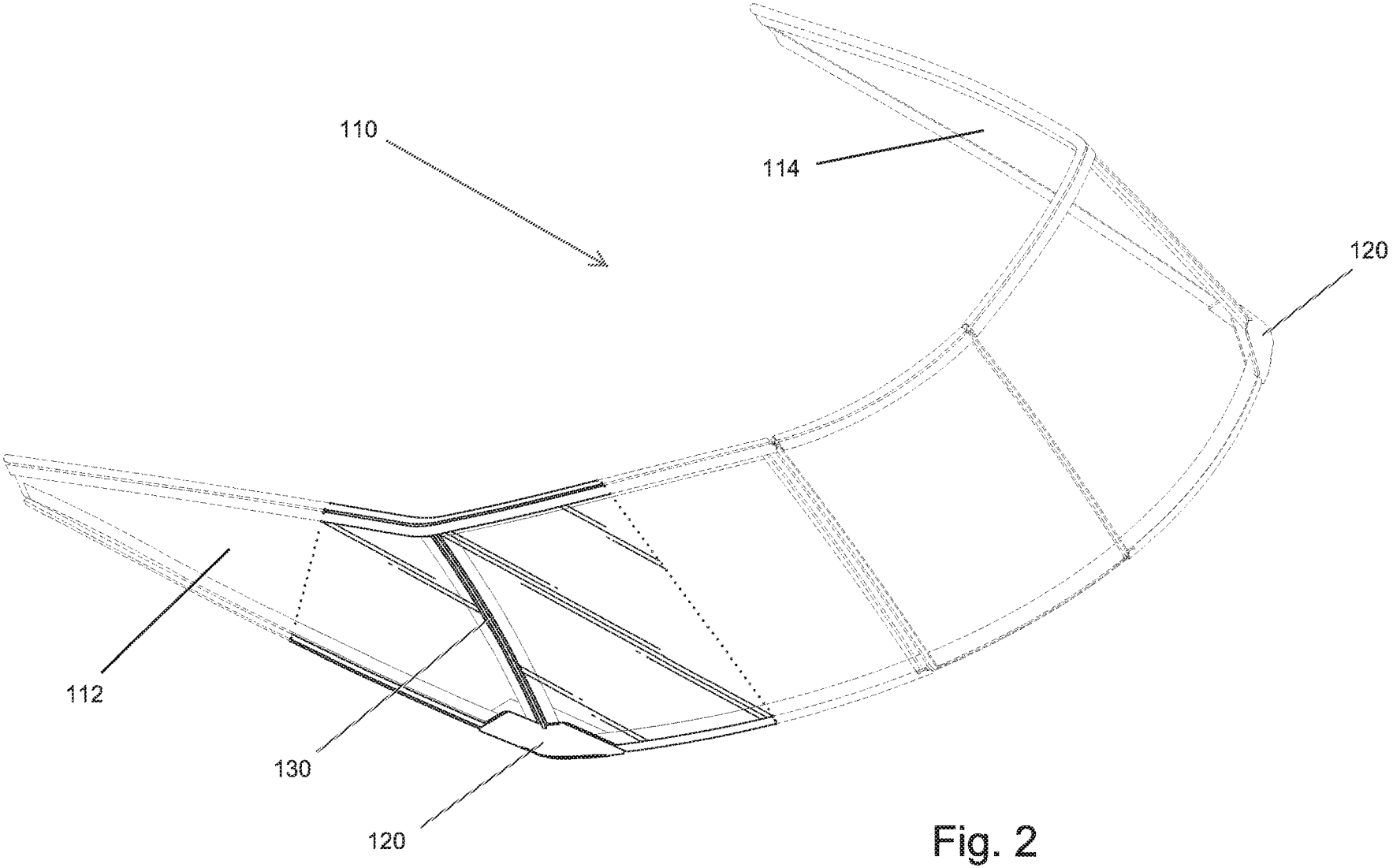
FIGS. 2 and 3 show an alternative embodiment with the windshield including pillars.
Figure 3:
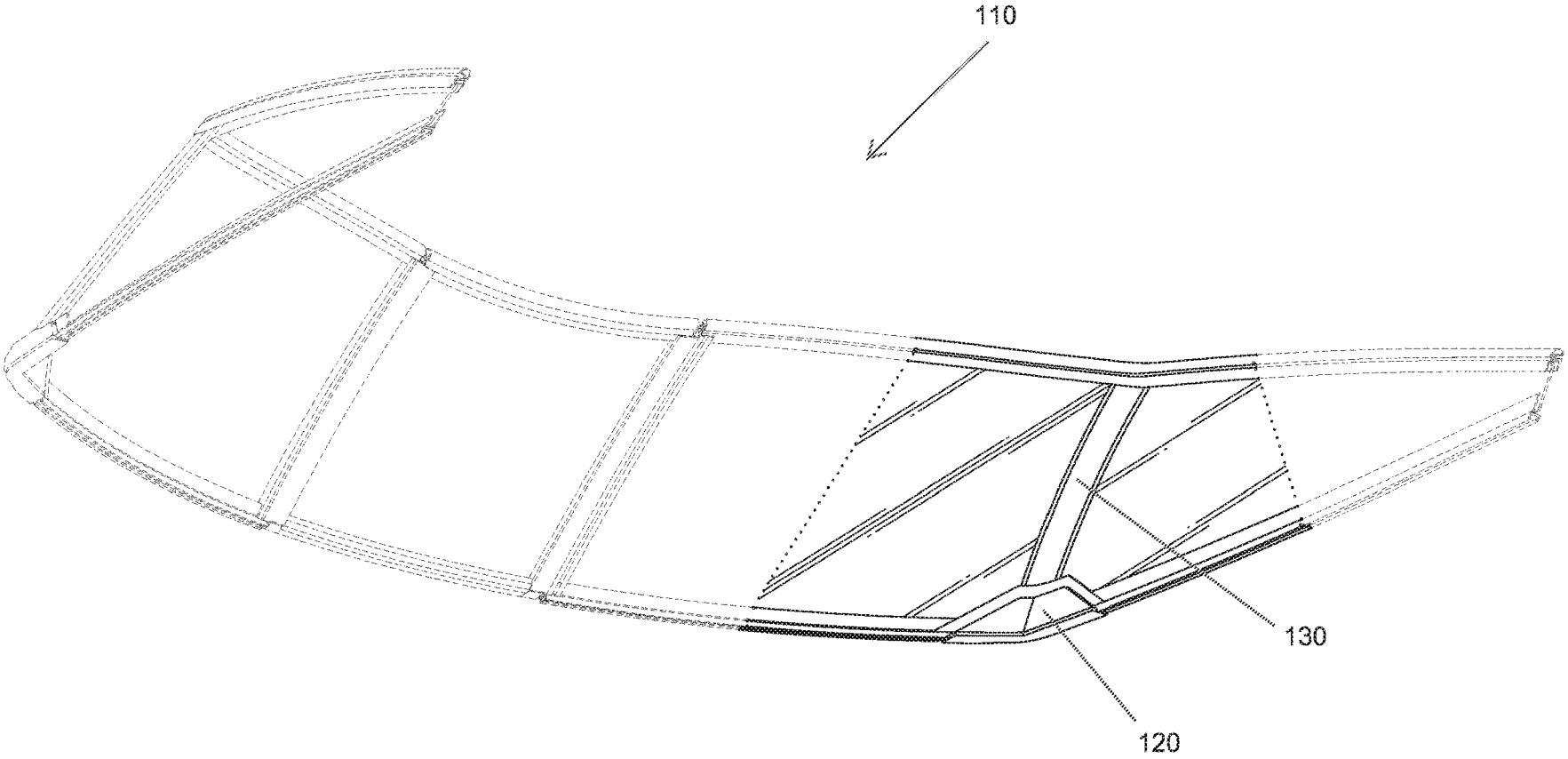

In an alternative construction shown in FIGS. 2-3, the windshield assembly 110 may incorporate transition members 120 and a windshield that includes pillars 130. As shown, the first and second pillars 130 engage an inside portion of the transition members 120. With the pillar construction, the windshield assembly 110 may be constructed with multiple parts for the respective starboard section 112, port section 114 and center section 116. In contrast with the embodiment shown in FIG. 1, the radii between the respective sections may be tighter than the turns on the deck profile. The transition members 120 in this context are similarly configured to adapt the transition areas of the windshield to the deck profile.

The windshield assembly incorporating the transition members of the described embodiments enables the use of glass corner windshields on tight deck profiles where such windshields could not previously fit. The forward corner design of the transition members acts as an adapter between the tight deck profiles and the windshield glass, facilitating the installation of the glass corner windshields. The transition members may similar adapt the windshield glass with a tighter radius between side sections and a center section to a deck profile with looser radii. The transition members can also advantageously provide additional functionality in the windshield assembly.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A marine windshield assembly comprising:

a windshield including a starboard side section, a port side section, and a center section between the starboard side section and the port side section, wherein transition areas of the windshield between the starboard side section and the center section and between the port side section and the center section, respectively, each comprise a transition radius; and a bottom trim member securable to a deck or frame with a profile including a starboard corner radius and a port corner radius, the bottom trim member supporting the windshield, wherein the bottom trim member comprises a pair of transition members disposed at the transition areas of the windshield, wherein the transition members comprise an outermost bend point that extends into the starboard and port corner radii, and wherein the transition areas of the windshield extend across a top of the transition members aft and inward from the outermost bend point.

2. A marine windshield assembly according to claim 1, wherein the starboard corner radius and the port corner radius are different from the transition radii.

3. A marine windshield assembly according to claim 1, wherein the profile includes starboard and port outermost corners, and wherein the transition members are configured to occupy the starboard and port outermost corners of the profile.

4. A marine windshield assembly according to claim 3, wherein the outermost bend points match the outermost corners of the profile, and wherein the transition members extend aft and inward from the outermost bend point to an inside point.

5. A marine windshield assembly according to claim 4, wherein the transition areas of the windshield extend adjacent the inside point of the transition members.

6. A marine windshield assembly according to claim 3, wherein the transition areas of the windshield are configured to cut across the outermost corners of the profile aft and inward of the outermost corners of the profile.

7. A marine windshield assembly according to claim 1, wherein the transition members extend through the windshield.

8. A marine windshield assembly according to claim 1, wherein the transition members comprise a functional component.

9. A marine windshield assembly according to claim 1, wherein the transition areas comprise a first pillar between the starboard side section and the center section and a second pillar between the port side section and the center section.

10. A marine windshield assembly according to claim 9, wherein the first and second pillars engage an inside portion of the transition members.

11. A marine windshield assembly comprising:

a windshield including a starboard side section, a port side section, and a center section between the starboard side section and the port side section, wherein transition areas of the windshield between the starboard side section and the center section and between the port side section and the center section, respectively, each comprise a transition radius; and a bottom trim member securable to a deck or frame with a profile including a starboard corner radius and a port corner radius, the bottom trim member supporting the windshield, wherein the bottom trim member comprises a pair of transition members disposed at the transition areas of the windshield, the transition members being configured to adapt the transition areas of the windshield to the starboard and port corner radii of the profile, wherein the transition members comprise a functional component, and wherein the functional component is a light source.

12. A marine windshield assembly comprising:

a windshield including a starboard side section, a port side section, and a center section between the starboard side section and the port side section; and a bottom trim member securable to a deck or frame with a profile including starboard and port outermost corners, the bottom trim member supporting the windshield, wherein the bottom trim member comprises a pair of transition members disposed at respective transition areas between the starboard side section and the center section and between the port side section and the center section, the transition members extending into the starboard and port outermost corners of the deck profile, wherein the windshield is configured to cut across a top of the transition members aft and inward of the starboard and port outermost corners.

13. A marine windshield assembly according to claim 12, wherein a trim radius of the transition members at junctions between the starboard side section and the center section and between the port side section and the center section is smaller than a radius of the windshield at the transition areas.

14. A marine windshield assembly according to claim 12, wherein the transition members comprise an outermost bend point that matches the outermost corners of the profile, and wherein the transition members extend aft and inward from the outermost bend point to an inside point.

15. A marine windshield assembly according to claim 14, wherein the transitions areas of the windshield extend adjacent the inside point of the transition members.

16. A marine windshield assembly according to claim 12, wherein the transition areas comprise a first pillar between the starboard side section and the center section and a second pillar between the port side section and the center section.

17. A marine windshield assembly according to claim 16, wherein the first and second pillars engage an inside portion of the transition members.

* * * * *